United States Patent [19]

Shimada et al.

[11] 4,388,899

[45] Jun. 21, 1983

[54] NOISELESS COVERS

[75] Inventors: Kiyoshi Shimada, Yokosuka; Naoki Ogawa, Yokohama, both of Japan

[73] Assignee: Nissan Motor Co., Ltd., Yokohama, Japan

[21] Appl. No.: 244,896

[22] Filed: Mar. 18, 1981

[30] Foreign Application Priority Data

Apr. 2, 1980 [JP] Japan ..... 55-44543[U]

[51] Int. Cl.[3] ..... F02B 77/13; F02F 7/00

[52] U.S. Cl. ..... 123/198 E; 123/195 C; 123/90.38

[58] Field of Search ..... 123/198 E, 195 C, 90.38

[56] References Cited

FOREIGN PATENT DOCUMENTS 51-1630 1/1976 Japan ..... 123/198 E 2074645 11/1981 United Kingdom ..... 123/195 C

*Primary Examiner*—Wendell E. Burns

[57] ABSTRACT

A noiseless cover such as an oil pan, front cover, cylinder head cover and the like for an engine comprises elastic bodies fixed to an engine body of the engine and resiliently abutting against a mid-portion of the cover, thereby preventing surface vibrations of the cover without any troublesome operation for mounting the cover and without any sealing problem.

5 Claims, 6 Drawing Figures

NOISELESS COVERS

BACKGROUND OF THE INVENTION

1. Field of the Invention

The present invention relates to noiseless covers such as oil pans, cylinder head covers, front covers and the like, adapted to restrain noise from engines.

2. Description of the Prior Art

In usual engines for automobiles, covers such as oil pans, cylinder head covers, front covers and the like are secured to cylinder blocks and cylinder heads constituting engine bodies. These covers are, however, aluminum casts or steel plates formed by pressing which have generally poor damping capacity to increase noise radiation coefficient (a ratio of noise energy to received vibration energy) which provide a problem for engine noise. Particularly, oil pans are mostly of mild steel plates formed by pressing, so that they tend to cause surface vibrations by applied vibrating forces. In addition, resonance frequencies of the surface vibrations are in medium frequency zones which are the most acute zones in the problem of engine noise, with the result that the radiation of the engine noise greatly increases. For example, the noise from an oil pan is often as much as more than 15% of all the noise from an engine, and it becomes more than 20% in case of a deep oil pan.

In order to prevent such a noise from covers, one solution is to make the covers thicker to restrain surface vibration thereof. On the other hand, however, the thicker covers increases vibrations of higher frequencies and total weights of engines.

To solve this problem, a noiseless cover as shown in FIG. 1 has been proposed, wherein a mounting member 6 embracing an elastic material 5 connects part of a cylinder block 1, for example, a bearing cap as shown with a mid-portion of an oil pan 3 whose peripheral portions are fixed to the cylinder block 1 of an engine body. The mounting member 6 is generally a usual antivibration type. With this arrangement, the mid-portion of the oil pan is resiliently supported through the mounting member 6 by the cylinder block 1, so that even if the vibration is transmitted from the engine body to the oil pan, the vibration would be absorbed or damped by the mounting member 6, thereby preventing the surface vibration of the oil pan, whereby the radiation of noise is therefore prevented.

With this arrangement, however, the mounting member 6 must be incorporated in place simultaneously in mounting the oil pan on the engine body, thereby making difficulty the mounting of the oil pan. In addition, with this arrangement the mounting member 6 gives rise to a further problem to ensure a sealing of the oil pan at the mounting member 6.

SUMMARY OF THE INVENTION

It is a primary object of the invention to provide improved covers which eliminate all the disadvantages of the prior art.

It is a further object of the invention to provide improved covers each comprising elastic bodies fixed to an engine body and resiliently abutting against a mid-portion of the cover, thereby preventing surface vibrations of the covers without any troublesome operation for mounting the covers and without any problem in sealing.

In order that the invention may be more clearly understood, preferred embodiments will be described, by way of example, with reference to the accompanying drawings.

DETAILED DESCRIPTION OF THE PREFERRED EMBODIMENT

Figure 1:
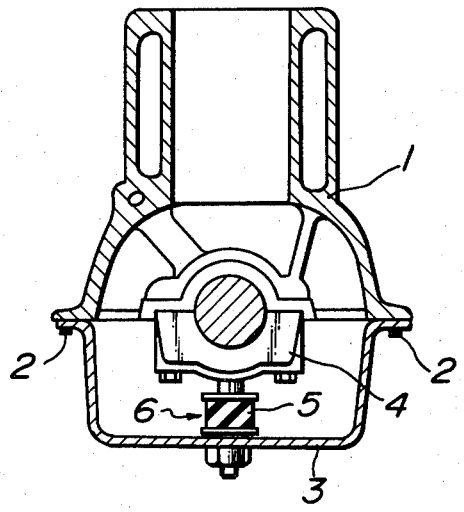
FIG. 1 PRIOR ART
FIG. 1 is a sectional view showing a mounting of an oil pan of the prior art as mentioned above.
Figure 2:
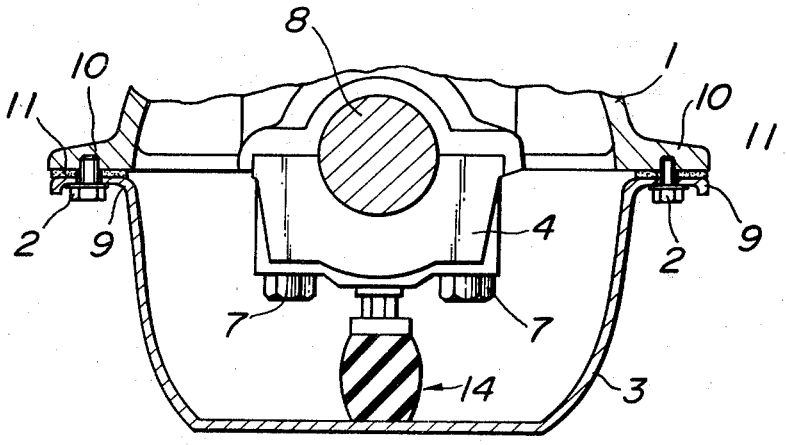
FIG. 2 is a front sectional view showing a mounting of an oil pan according to the invention.
Figure 3:
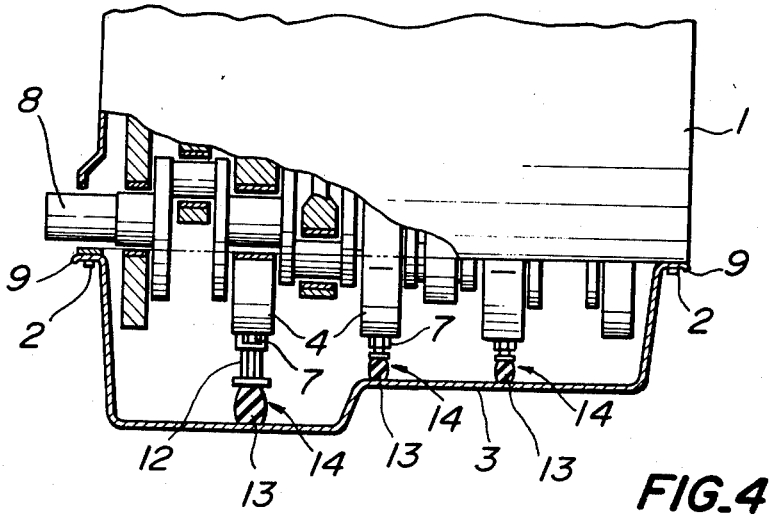
FIG. 3 is a side elevation of the oil pan shown in FIG. 2 with an engine partially broken away.
Figure 4:
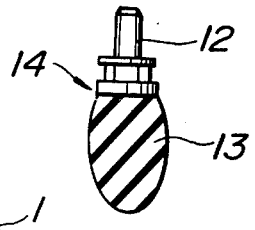
FIG. 4 is an enlarged front elevation of an antivibration member according to the invention.

Referring to FIGS. 2 and 3 illustrating one embodiment of the invention applied to an oil pan, wherein the oil pan 3 has a flange 9 formed along its circumference, which is fixed through a gasket 11 in a liquid-tight manner by means of a number of bolts 2 to an opposite flange 10 of a cylinder block 1 of an engine body to which is fixed a bearing cap 4 by means of bolts 7 for journaling a crankshaft 8. An antivibration member 14 is secured to a bottom end of the bearing cap 4. As shown in FIG. 4 on an enlarged scale, the antivibration member 14 comprises a mounting threaded rod 12 and an elastic material (rubber in this embodiment) 13 in the form of a bobbin fixed to the threaded rod 12 by baking in a manner such that a lower end of the elastic material 13 resiliently abuts against the mid-portion of an inner bottom surface of the oil pan 3 when the oil pan 3 is secured to the cylinder block 1. The elastic material 13 is of course preferably oil-resistant. The elastic material in the form of the bobbin serves to freely deform itself without flexing the oil pan when the elastic material abuts thereagainst. It is of course that the lower end of the elastic material in its free condition is at a lower level than that of the inner surface of the oil pan 3.

With this arrangement, the mid-portion of the bottom of the oil pan 3 is therefore resiliently supported through the antivibration member 14 by the engine body, so that even if the vibration from the engine body is transmitted to the oil pan 3 through its circumference, the vibration would be absorbed or damped by the elastic body 13 to prevent the surface vibration of the oil pan 3. In mounting the oil pan onto the engine body, moreover, all that is required is to secure the flange of the oil pan 3 to the engine body (cylinder block) without any troublesome operation and without requiring sealing at the mounted portion of the elastic member.

The antivibration members 14 are preferably located along the center line of the oil pan to increase its antivibrating effect. As shown in FIG. 3, all bearing caps are provided with respective antivibration members to more increase the antivibrating effect.

Figure 5:
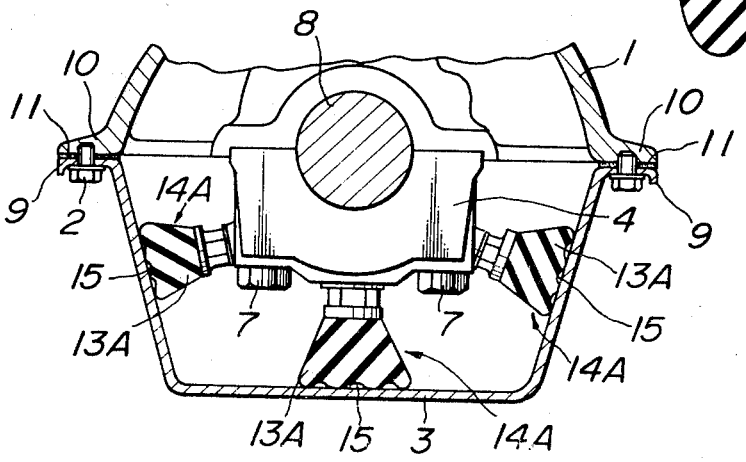
FIG. 5 is a sectional front elevation of another embodiment of the invention.

Referring to FIG. 5 illustrating a further embodiment of the invention, an elastic body 13A of an antivibration member 14A is frusto-conical or trapezoid in section and has a wave-formed bottom 15. The wave formed bottom 15 resiliently abuts against an oil pan 3. In this embodiment, the oil pan 3 is supported with its wider area at a lower surface pressure by the antivibration member to further improve the antivibrating effect. In stead of a plurality of the antivibration members 14A as shown, a single antivibration member 14A abutting against the mid-portion of the oil pan also provides a sufficient antivibrating effect as in the preceeding embodiment.

Figure 6:
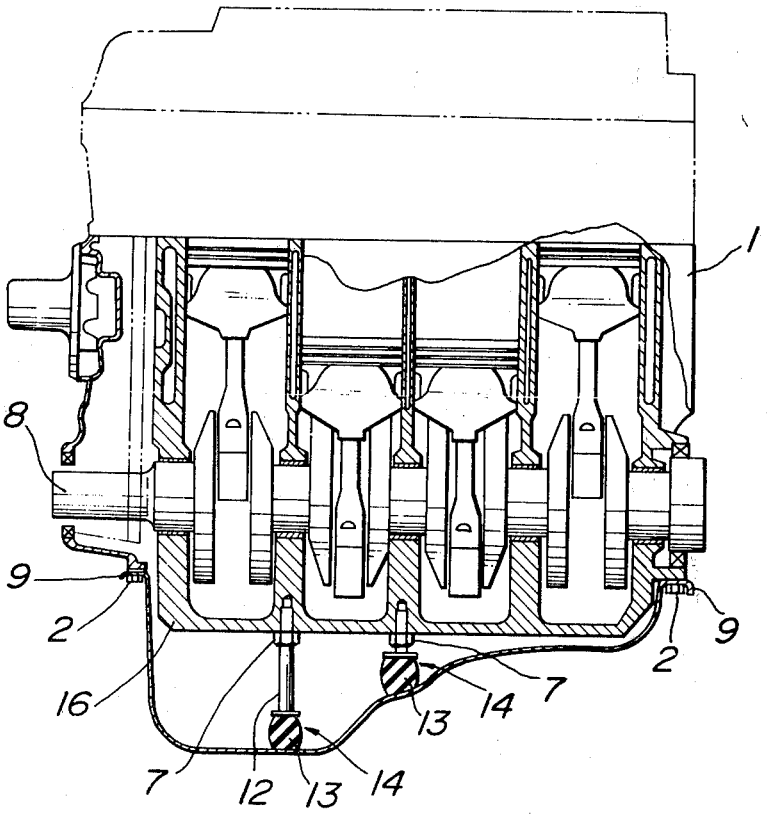
FIG. 6 is a sectional view of a bearing beam type engine applied with the present invention.

FIG. 6 illustrates an application of the invention to a bearing beam type engine body. With this engine body, respective journals of a crankshaft are supported by a bearing beam 16. The same antivibrating effect is also provided by the antivibration members according to the invention.

The invention can of course be applicable to front covers or cylinder head covers although the embodiments applied to the oil pans have been explained.

As can be seen from the above explanation, according to the invention elastic bodies fixed to an engine body resiliently abut against a mid-portion of an inner surface of a cover to restrain the mid-portion of the cover, thereby absorbing and damping the vibration transmitted from the engine body to the cover, whereby the surface vibration of the cover is prevented to suppress an generation of noise without any troublesome operation for mounting the cover and to eliminate the problem of sealing.

It is further understood by those skilled in the art that the foregoing description is preferred embodiments of the disclosed covers and that various changes and modifications may be made in the invention without departing from the spirit and scope thereof.

What is claimed is:

1. A noiseless cover such as an oil pan, front cover, cylinder head cover and the like mounted with its circumference onto an engine body, said cover comprising an elastic body fixed to part of said engine body and resiliently abutting against a mid-portion of an inner surface of said cover.

2. A noiseless cover as set forth in claim 1, wherein said elastic body is in the form of a bobbin.

3. A noiseless cover as set forth in claim 2, wherein said elastic body comprises a mounting thread rod to which the bobbin-shaped elastic body is fixed by baking.

4. A noiseless cover as set forth in claim 1, wherein said elastic body is frusto-conical in section and has a wave-formed bottom.

5. A noiseless cover as set forth in claim 1, wherein said elastic body is trapezoid in the section and has a wave-formed bottom.

* * * * *